US010614773B2

(12) United States Patent
Xi et al.

(10) Patent No.: US 10,614,773 B2
(45) Date of Patent: Apr. 7, 2020

(54) DISPLAY METHOD, IMAGE PROCESSING DEVICE, DISPLAY DEVICE, AND STORAGE MEDIUM

(71) Applicant: BOE TECHNOLOGY GROUP CO., LTD., Beijing (CN)

(72) Inventors: Yanhui Xi, Beijing (CN); Bin Dai, Beijing (CN); Xiaomang Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/992,658

(22) Filed: May 30, 2018

(65) Prior Publication Data

US 2019/0096360 A1 Mar. 28, 2019

(30) Foreign Application Priority Data

Sep. 25, 2017 (CN) ..... 2017 1 0877958

(51) Int. Cl.
*G09G 5/00* (2006.01)
*G09G 3/20* (2006.01)
*G09G 3/36* (2006.01)

(52) U.S. Cl.
CPC ..... *G09G 5/005* (2013.01); *G09G 3/2003* (2013.01); *G09G 3/2092* (2013.01);
(Continued)

(58) Field of Classification Search
CPC .... G09G 5/005; G09G 3/2003; G09G 3/2092; G09G 3/3607; G09G 2300/0452; G09G 2340/0457; G09G 2350/00
See application file for complete search history.

(56) References Cited

U.S. PATENT DOCUMENTS

2006/0061531 A1* 3/2006 Park ..... G09G 3/2003 345/88
2007/0046603 A1* 3/2007 Smith ..... G09G 3/3216 345/90

(Continued)

FOREIGN PATENT DOCUMENTS

CN 103886809 A 6/2014
CN 104794998 A 7/2015

(Continued)

OTHER PUBLICATIONS

First Chinese Office Action dated Dec. 23, 2019.

*Primary Examiner* — Stephen G Sherman
(74) *Attorney, Agent, or Firm* — Dilworth & Barrese, LLP; Michael J. Musella, Esq.

(57) ABSTRACT

A display method, an image processing device, a display device, and a storage medium are provided. The display method includes: receiving first image information, and transforming the first image information into second image information. The first image information is image information to be displayed by a first pixel structure; the first pixel structure includes a plurality of first pixels which are arrayed, each of the first pixels includes three first sub-pixels sequentially provided along a first direction; all of the first sub-pixels are arranged into a plurality of rows extending along the first direction, and in a second direction different from the first direction, the first sub-pixels in adjacent rows are aligned with each other; the second image information is image information to be displayed by a BV3 pixel structure.

13 Claims, 5 Drawing Sheets

(52) U.S. Cl.
CPC ... *G09G 3/3607* (2013.01); *G09G 2300/0452* (2013.01); *G09G 2340/0457* (2013.01); *G09G 2350/00* (2013.01)

(56) References Cited

U.S. PATENT DOCUMENTS

| | | | |
|---|---|---|---|
| 2016/0027359 | A1 | 1/2016 | Guo et al. |
| 2017/0103690 | A1 | 4/2017 | Yang et al. |

FOREIGN PATENT DOCUMENTS

| | | | |
|---|---|---|---|
| CN | 106531073 | A | 3/2017 |
| CN | 107068035 | A | 8/2017 |

* cited by examiner

DISPLAY METHOD, IMAGE PROCESSING DEVICE, DISPLAY DEVICE, AND STORAGE MEDIUM

CROSS-REFERENCE TO RELATED APPLICATIONS

The application claims priority to Chinese patent application No. 201710877958.2, filed on Sep. 25, 2017, the entire disclosure of which is incorporated herein by reference as part of the present application.

TECHNICAL FIELD

Embodiments of the present disclosure relate to a display method, an image processing device, a display device, and a storage medium.

BACKGROUND

Resolution of the display panel is increasing with the development of display technology. However, display panels with high resolution have to deal with the issue of large data process load and difficulties in data transmission. A BV3 (Bright View III) pixel structure can address the problems of large data process load and difficulties in data transmission of the display panels with high resolution.

SUMMARY

At least one embodiment of present disclosure provides a display method, the display method comprises: receiving first image information, and transforming the first image information into second image information. The first image information is image information to be displayed by a first pixel structure; the first pixel structure comprises a plurality of first pixels which are arrayed, each of the first pixels comprises three first sub-pixels sequentially provided along a first direction; all of the first sub-pixels are arranged into a plurality of rows extending along the first direction, and in a second direction different from the first direction, the first sub-pixels in adjacent rows are aligned with each other; the second image information is image information to be displayed by a BV3 pixel structure.

For example, in at least one example of the display method, the first image information comprises image information for the plurality of first sub-pixels, in which image information of each first sub-pixel is used for allowing the each first sub-pixel to display; and transforming of the first image information into the second image information comprises: obtaining the second image information through rendering algorithm of rearrangement after deletion or rendering algorithm of rearrangement after mergence with respect to image information of all the first sub-pixels in the first image information, in which the second image information comprises image information of a plurality of second sub-pixels, and image information of each second sub-pixel in the BV3 pixel structure is used for allowing the each second sub-pixel to display.

Further, for example, in at least one example of the display method, obtaining of the second image information through the rendering algorithm of rearrangement after deletion with the image information of all the first sub-pixels in the first image information comprises: dividing the image information of all the first sub-pixels in the first image information into groups; and for the image information of the twelve first sub-pixels comprised by each group, deleting image information of part of the first sub-pixels, and performing position rearrangement to image information of remaining first sub-pixels so as to obtain the second image information. Each group comprises image information of twelve first sub-pixels, the image information of the twelve first sub-pixels is used for allowing four first pixels which are arrayed to display, and the four first pixels which are arrayed comprises two rows of first pixels with two first pixels provided in each row of first pixels, every two first pixels arranged along the first direction are adjacent to each other, and every two first pixels arranged along the second direction are adjacent to each other.

Alternatively, for example, in at least one example of the display method, obtaining of the second image information through the rendering algorithm of rearrangement after mergence with the image information of all the first sub-pixels in the first image information comprises: dividing the image information of all the first sub-pixels in the first image information into groups; and for the image information of the twelve first sub-pixels comprised by each group, adding products, obtained through multiplying data voltages of image information of the first sub-pixels, which are used for allowing the first sub-pixels of same one color and arranged in same one row to display, with respective weight coefficients, to obtain image information of the second sub-pixels, and performing position rearrangement to the image information of the second sub-pixels so as to obtain the second image information. Each group comprises image information of twelve first sub-pixels, the image information of the twelve first sub-pixels is used for allowing four first pixels which are arrayed to display; the four first pixels which are arrayed comprises two rows of first pixels with two first pixels provided in each row of first pixels, every two first pixels arranged along the first direction are adjacent to each other, and every two first pixels arranged along the second direction are adjacent to each other.

Further, for example, in at least one example of the display method, for the image information of the twelve first sub-pixels comprised by each group, a sum of the respective weight coefficients of the data voltages of the image information of the first sub-pixels, which are used for allowing the first sub-pixels of same one color and arranged in same one row to display, is one.

At least one embodiment of present disclosure provides an image processing device for a display device with a BV3 pixel structure. The image processing device comprises a reception unit and a processing unit. The reception unit is configured for receiving first image information, in which the first image information is image information to be displayed by a first pixel structure; the first pixel structure comprises a plurality of first pixels which are arrayed, each of the first pixels comprises three first sub-pixels sequentially provided along a first direction; all of the first sub-pixels are arranged into a plurality of rows extending along the first direction, and in a second direction different from the first direction, the first sub-pixels in adjacent rows are aligned with each other; the processing unit is coupled to the reception unit, and is configured for transforming the first image information into second image information, in which the second image information is image information to be displayed by a BV3 pixel structure.

For example, in at least one example of the image processing device, the first image information comprises image information of the plurality of first sub-pixels, in which image information of each first sub-pixel is used for allowing the each first sub-pixel to display; and the processing unit is configured for obtaining the second image information through rendering algorithm of rearrangement after deletion or rendering algorithm of rearrangement after mergence with respect to image information of all the first sub-pixels in the first image information, in which the second image information comprises image information of a plurality of second sub-pixels, and image information of each second sub-pixel in the BV3 pixel structure is used for allowing the each second sub-pixel to display.

Further, for example, in at least one example of the image processing device, the processing unit is configured for dividing the image information of all the first sub-pixels in the first image information into groups, in which each group comprises image information of twelve first sub-pixels, the image information of the twelve first sub-pixels is used for allowing four first pixels which are arrayed to display, the four first pixels which are arrayed comprises two rows of first pixels with two first pixels provided in each row of first pixels, every two first pixels arranged along the first direction are adjacent to each other, and every two first pixels arranged along the second direction are adjacent to each other; and the processing unit is further configured for, for the image information of the twelve first sub-pixels comprised by each group, deleting image information of part of the first sub-pixels, and performing position rearrangement to image information of remaining first sub-pixels so as to obtain the second image information.

Alternatively, for example, in at least one example of the image processing device, the processing unit is configured for dividing the image information of all the first sub-pixels in the first image information into groups, in which each group comprises image information of twelve first sub-pixels, the image information of the twelve first sub-pixels is used for allowing four first pixels which are arrayed to display, the four first pixels which are arrayed comprises two rows of first pixels with two first pixels provided in each row of first pixels, every two first pixels arranged along the first direction are adjacent to each other, and every two first pixels arranged along the second direction are adjacent to each other; and the processing unit is further configured for, for the image information of the twelve first sub-pixels comprised by each group, adding products, obtained through multiplying data voltages of image information of the first sub-pixels, which are used for allowing the first sub-pixels of same one color and arranged in same one row to display, with respective weight coefficients, to obtain image information of the second sub-pixels, and performing position rearrangement to the image information of the second sub-pixels so as to obtain the second image information.

At least one embodiment of present disclosure provides an image processing device including a processor, a memory and one or more computer program modules. The one or more computer program modules are stored in the memory and are executed by the processor, the one or more computer program modules comprise instructions to execute and realize the above-mentioned display method.

At least one embodiment of present disclosure provides a storage medium for storing non-transitory computer readable instructions, as executed by a computer, the non-transitory computer readable instructions performs the above-mentioned display method.

At least one embodiment of present disclosure provides a display device including the above-mentioned image processing device.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

As mentioned above, the BV3 pixel structure can address the problems of large data process load and difficulties in data transmission of the display panels with high resolution. Therefore, applications of the display panels with the BV3 pixel structure are becoming increasingly widespread. However, the existing images or videos have been prepared still for traditional Real RGB display panels and comprise corresponding image information. Therefore, a corresponding transformation processing in advance and a special purposed transformation device are needed to display these images or videos for the traditional Real RGB display panels. This leads to an increase in cost and limits applications of the display panels with the BV3 pixel structure.

Figure 1:
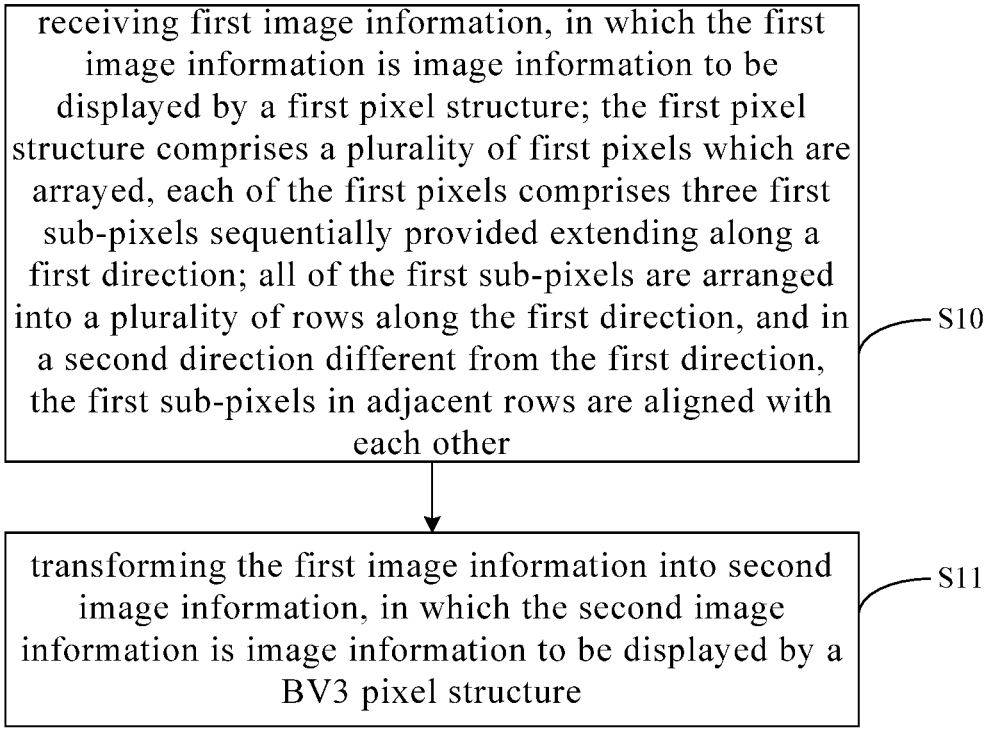
FIG. 1 is a first exemplary flow chart of a display method provided by an embodiment of present disclosure.

An embodiment of present disclosure provides a display method, as illustrated in FIG. 1, the display method comprises the following steps S10~S11.

Step S10: receiving first image information, in which the first image information is image information to be displayed by a first pixel structure.

Figure 2:
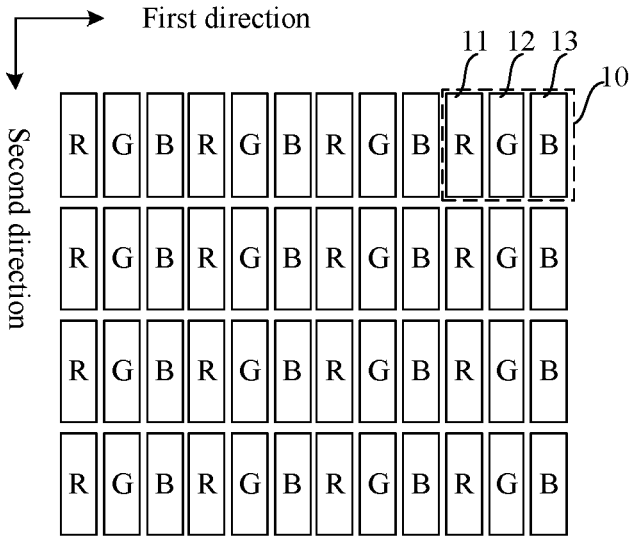
FIG. 2 is a schematic diagram of a Real RGB pixel structure provided by an embodiment of present disclosure.

As illustrated in FIG. 2, the first pixel structure comprises a plurality of first pixels 10 which are arrayed, each of the first pixels 10 comprises three first sub-pixels sequentially provided along a first direction; all of the first sub-pixels are arranged into a plurality of rows extending along the first direction; and in a second direction, the first sub-pixels in adjacent rows are aligned with each other.

The first image information is the image information to be displayed by the first pixel structure, that is, a display panel with the first pixel structure can display images in a case that the first image information is inputted into the display panel with the first pixel structure.

As illustrated in FIG. 2, in one embodiment, each of the first pixels 10 can comprise a red (R) first sub-pixel 11, a green (G) first sub-pixel 12 and a blue (B) first sub-pixel 13, and the red (R) first sub-pixel 11, the green (G) first sub-pixel 12 and the blue (B) first sub-pixel 13 are arranged along the first direction. In a second direction perpendicular to the first direction, the sub-pixels in each column are sub-pixels of the same one color. As illustrated in figures, all the sub-pixels in a first column are red sub-pixels, all the sub-pixels in a second column are green sub-pixels, all the sub-pixels in a third column are blue sub-pixels . . . , for example.

In such cases, the first pixel structure can be referred to as a Real RGB pixel structure.

It should be understood that, the embodiment of present disclosure is described by taking an example that the first pixel 10 comprises the red first sub-pixel 11, the green first sub-pixel 12 and the blue first sub-pixel 13, which is illustrated in FIG. 2, but the embodiment of present disclosure is not limited into the case that colors of three first sub-pixel in the first pixel 10 are red, green and blue, the colors of the three first sub-pixel in the first pixel 10 can also be other three kinds of colors which can form three primary colors, for example, cyan, magenta, and yellow (CMY), which are complementary colors of RGB.

Furthermore, the first direction and the second direction are not parallel to each other, that is, the first direction and the second direction intersects with each other. In one embodiment illustrated in FIG. 2, with respect to paper, the first direction can be a horizontal direction, and the second direction can be a perpendicular direction.

Step S11: transforming the first image information into second image information, in which the second image information is image information to be displayed by a BV3 pixel structure.

The second image information is the image information to be displayed by the BV3 pixel structure, that is, a display panel with the BV3 pixel structure can display images in a case that the second image information is inputted into the display panel with the BV3 pixel structure.

Figure 3:
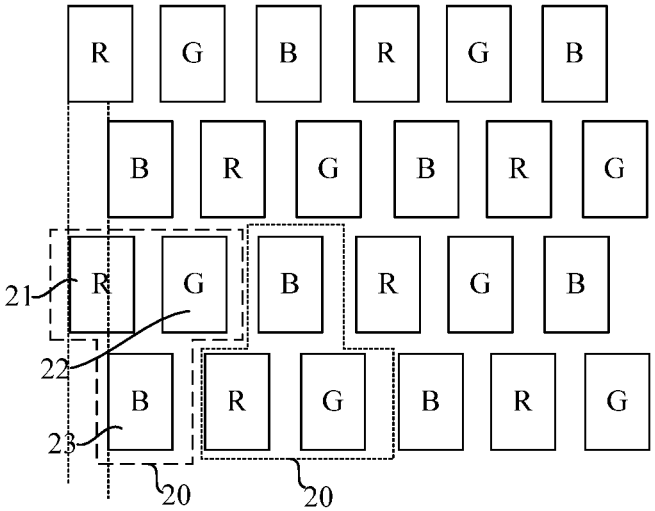
FIG. 3 is a schematic diagram of a BV3 pixel structure provided by an embodiment of present disclosure.

As illustrated in FIG. 3 the BV3 pixel structure comprises a plurality of rows of second sub-pixels arranged in parallel along the second direction, in which the second sub-pixels located at the beginning positions of adjacent rows are staggered with each other by half a width of the second sub-pixel, and each second sub-pixel and the second sub-pixels adjacent to the each second sub-pixel are different in colors.

In one embodiment as illustrated in FIG. 3, the second sub-pixels in odd-numbered rows can comprise red (R) second sub-pixels 21, green (G) second sub-pixels 22 and blue (B) second sub-pixels 23, which are sequentially and repeatedly provided, and the second sub-pixels in even-numbered rows can comprise blue (B) second sub-pixels 23, red (R) second sub-pixels 21 and green (R) second sub-pixels 22, which are sequentially and repeatedly provided. Alternatively, the second sub-pixels in odd-numbered rows can comprise blue (B) second sub-pixels 23, green (G) second sub-pixels 22 and red (R) second sub-pixels 21, which are sequentially and repeatedly provided, and the second sub-pixels in even-numbered rows can comprise red (R) second sub-pixels 21, blue (B) second sub-pixels 23, and green (R) second sub-pixels 22, which are sequentially and repeatedly provided. No specific limitations are given to the embodiment of present disclosure.

In the present disclosure, as illustrated in FIG. 3, the second sub-pixels with three different colors and arranged in a Δ shape can be referred to as one second pixel 20.

It should be understood that, the embodiment of present disclosure is described by taking an example that the BV3 pixel structure comprises the red the second sub-pixel 21, the green second sub-pixel 22 and the blue second sub-pixel 23 (i.e., the second sub-pixels with three colors), which is illustrated in FIG. 3, but the embodiment of present disclosure is not limited into the case that colors of three second sub-pixels in the second pixel 20 are red, green and blue, the colors of three second sub-pixels in the second pixel 20 can also be other three colors which can form three primary colors, for example, cyan, magenta, and yellow (CMY).

In the display method provided by at least one embodiment of present disclosure, the second image information is obtained through transforming existing first image information for the first pixel structure, and can be displayed on the display panel with the BV3 pixel structure. The display method can avoid the need to provide the second image information suitable for the display panel with the BV3 pixel structure directly in advance and therefore cost can be reduced and application domains and scenarios of a display device adopting the display panel with the BV3 pixel structure can be increased.

Figure 4:
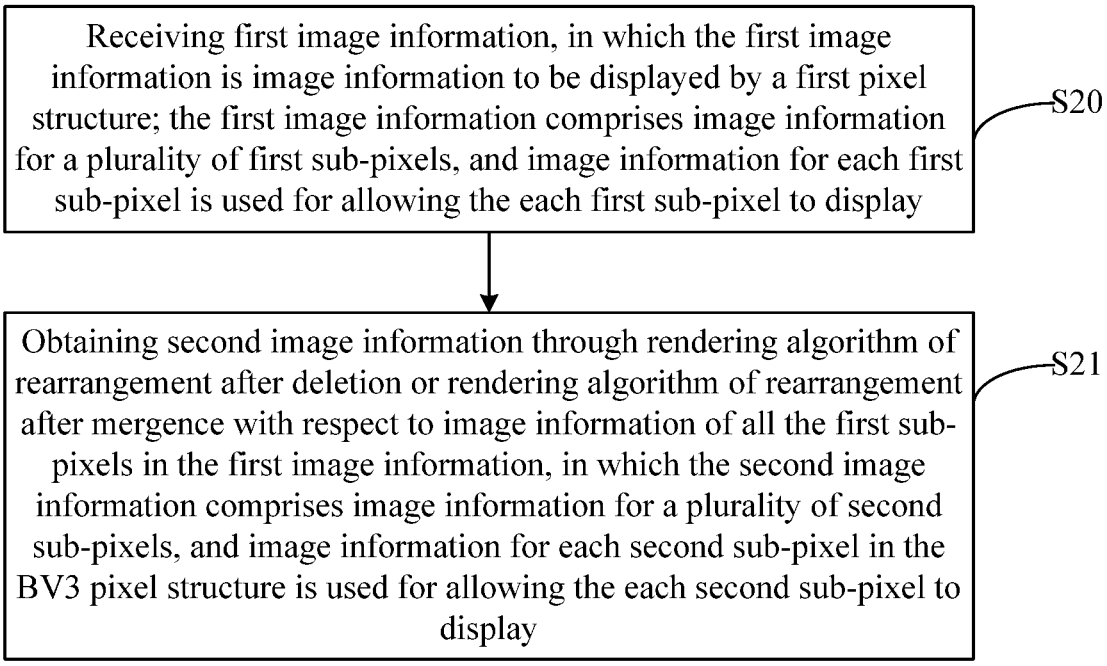
FIG. 4 is a second exemplary flow chart of a display method provided by an embodiment of present disclosure.

In the following, a specific example is given to describe the display method provided by an embodiment of present disclosure in detail. As illustrated in FIG. 4, the display method comprises the following step S20~S21.

Step S20: receiving first image information, in which the first image information is image information to be displayed by a first pixel structure; the first image information comprises image information for a plurality of first sub-pixels, and image information for each first sub-pixel is used for allowing the each first sub-pixel to display.

The first pixel structure can refer to FIG. 2 and the above-mentioned description related to FIG. 2, so no further descriptions is given herein.

In a case that the first pixel structure comprises N first sub-pixels, the first image information comprises image information for N first sub-pixels, and image information for first sub-pixels and the first sub-pixels have an one-to-one correspondence relationship therebetween.

Step S21: obtaining second image information through rendering algorithm of rearrangement after deletion or rendering algorithm of rearrangement after mergence with respect to image information of all the first sub-pixels in the first image information, in which the second image information comprises image information for a plurality of second sub-pixels, and image information for each second sub-pixel in the BV3 pixel structure is used for allowing the each second sub-pixel to display.

The BV3 pixel structure can refer to FIG. 3 and the above-mentioned description related to FIG. 3, so no further descriptions is given herein.

In a case that the BV3 pixel structure comprises M second sub-pixels, the second image information comprises image information for M second sub-pixels, and image information for second sub-pixel and the second sub-pixel have an one-to-one correspondence relationship therebetween, in which M is smaller than N.

In at least one example, the second image information can be obtained through the following two methods.

In the first method, the second image information is obtained through rendering algorithm of rearrangement after deletion with respect to image information of all the first sub-pixels in the first image information.

Figure 5:
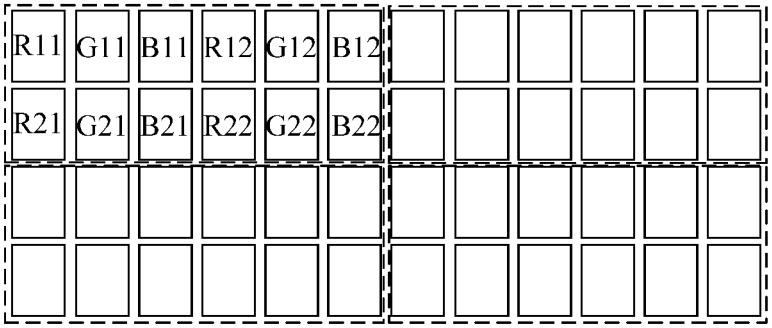
FIG. 5 is a schematic diagram to illustrate an arrangement after arranging image information of the first sub-pixels in first image information into an array, provided by an embodiment of present disclosure.

An example of the rendering algorithm of rearrangement after deletion can be performed through the following operations. For example, as illustrated in FIG. 5, the image information of all the first sub-pixels in the first image information can be divided into groups, each group comprises image information of twelve first sub-pixels (as illustrated by a dashed frame in FIG. 5), and the image information of the twelve first sub-pixels is used for allowing four first pixels 10 which are arrayed to display. The four first pixels 10 which are arrayed comprises two rows of first pixels 10, in each of which two first pixels 10 are provided, every two first pixels 10 arranged along the first direction are adjacent to each other, and every two first pixels 10 arranged along the second direction are adjacent to each other.

Figure 6:
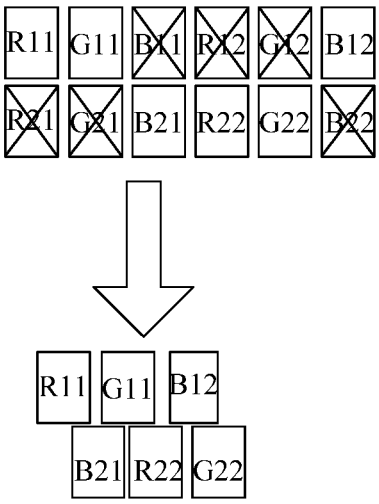
FIG. 6 is a schematic diagram illustrating an arrangement of image information of second sub-pixels formed by performing rearrangement after deletion with respect to image information of a group of first sub-pixels illustrated in FIG. 5.

On the basis of the result of regrouping, as illustrated in FIG. 6, for the image information of the twelve first sub-pixels comprised by each group, the second image information is obtained through deleting image information of part of the first sub-pixels, and then performing position rearrangement to image information of the remaining first sub-pixels.

Referring to FIG. 5 and FIG. 6 and taking an example that each group comprises the image information of the twelve first sub-pixels, the image information of the twelve first sub-pixels can respectively be:

(1) image information of the first sub-pixel which allows the red first sub-pixel 11 of the first pixel 10 located in a first row and a first column to display (which can be referred as R11 image information);

(2) image information of the first sub-pixel which allows the green first sub-pixel 12 of the first pixel 10 located in the first row and the first column to display (which can be referred as G11 image information);

(3) image information of the first sub-pixel which allows the blue first sub-pixel 13 of the first pixel 10 located in the first row and the first column to display (which can be referred as B11 image information);

(4) image information of the first sub-pixel which allows the red first sub-pixel 11 of the first pixel 10 located in a first row and a second column to display (which can be referred as R12 image information);

(5) image information of the first sub-pixel which allows the green first sub-pixel 12 of the first pixel 10 located in the first row and the second column to display (which can be referred as G12 image information);

(6) image information of the first sub-pixel which allows the blue first sub-pixel 13 of the first pixel 10 located in the first row and the second column to display (which can be referred as B12 image information);

(7) image information of the first sub-pixel which allows the red first sub-pixel 11 of the first pixel 10 located in a second row and a first column to display (which can be referred as R21 image information);

(8) image information of the first sub-pixel which allows the green first sub-pixel 12 of the first pixel 10 located in the second row and the first column to display (which can be referred as G21 image information);

(9) image information of the first sub-pixel which allows the blue first sub-pixel 13 of the first pixel 10 located in the second row and the first column to display (which can be referred as B21 image information);

(10) image information of the first sub-pixel which allows the red first sub-pixel 11 of the first pixel 10 located in a second row and a second column to display (which can be referred as R22 image information);

(11) image information of the first sub-pixel which allows the green first sub-pixel 12 of the first pixel 10 located in the second row and the second column to display (which can be referred as G22 image information); and

(12) image information of the first sub-pixel which allows the blue first sub-pixel 13 of the first pixel 10 located in the second row and the second column to display (which can be referred as B22 image information).

Based on the above, as illustrated in FIG. 6, the B11 image information, the R12 image information, the G12 image information, the R21 image information, the G21 image information, and the B22 image information can be deleted. On the other hand, the R11 image information, the G11 image information and the B21 image information, which are remained, can be used for allowing one second pixel 20 in the BV3 pixel structure to display, and the B12 image information, the R22 image information, and the G22 image information, which are remained, can be used for allowing another second pixel 20 in the BV3 pixel structure to display.

Later, in order to allow the finally obtained image information to be corresponding to the sub-pixels in the BV3 pixel structure, rearrangement to position information in the image information of the first sub-pixels is performed to obtain the second image information. That is, the second image information is obtained through position rearrangement with respect to image information of the remaining first sub-pixels after deletion. The data voltage of image information of each second sub-pixel is the data voltage of image information of the corresponding first sub-pixel before the position information is rearranged.

It should be understood that, showing the image information of the sub-pixels in FIG. 5 and FIG. 6 to be the same as corresponding pixel structures is to allow better understanding of the technical solution, but the views in FIG. 5 and FIG. 6 do not exist in actual image information, and both of the image information of the first sub-pixel and the image information of the second sub-pixel are include position information. The above-mentioned regrouping and deletion process can be realized based on the position information included in the image information for the first sub-pixels, and the second sub-pixel is allowed to display based on the position information included in the image information for the second sub-pixels.

Because the above-mentioned algorithm is simple, additional burdens to hardware and buffering in advance can be avoided, and advantages such as fast processing speed, capable of real time processing and good visual effect can be achieved.

In the second method, the second image information is obtained through rendering algorithm of rearrangement after mergence with respect to image information of all the first sub-pixels in the first image information.

An example of the rendering algorithm of rearrangement after mergence can be performed through the following operations. For example, as illustrated in FIG. 5, the image information for all the first sub-pixels in the first image information can be divided into groups, each group comprises image information of twelve first sub-pixels (as illustrated by a dashed frame in FIG. 5), and the image information of the twelve first sub-pixels is used for allowing four first pixels 10 which are arrayed to display. The four first pixels 10 which are arrayed comprises two rows of first pixels 10, in each of which two first pixels 10 are provided, every two first pixels 10 arranged along the first direction are adjacent to each other, and every two first pixels 10 arranged along the second direction are adjacent to each other.

Figure 7:
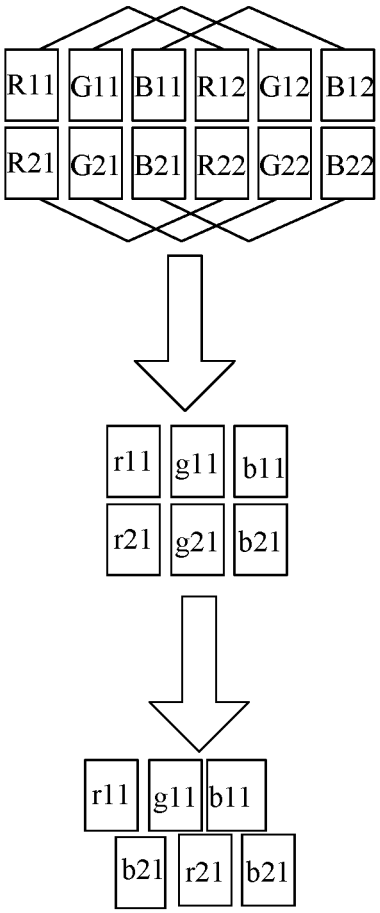
FIG. 7 is a schematic diagram illustrating an arrangement of image information of second sub-pixels formed by performing rearrangement after mergence with respect to image information of a group of first sub-pixels illustrated in FIG. 5.

On the basis of the result of regrouping, as illustrated in FIG. 7, for the image information of the twelve first sub-pixels comprised by each group, the second image information is obtained through adding products, which are obtained through multiplying data voltages of image information of the first sub-pixels, which are used for allowing the first sub-pixels of same one color and arranged in same one row to display, with respective weight coefficients, to obtain image information of the second sub-pixels, and then performing position rearrangement with respect to the obtained image information of the second sub-pixels.

For the image information of the twelve first sub-pixels comprised by each group, the sum of the respective weight coefficients of the data voltages of the image information of the first sub-pixels, which are used for allowing the first sub-pixels of same one color and arranged in same one row to display, is one (1).

Referring to FIG. 5 and FIG. 7 and taking an example that each group comprises the image information of the twelve first sub-pixels, the image information of the twelve first sub-pixels can respectively be:

(1) image information of the first sub-pixel which allows the red first sub-pixel 11 of the first pixel 10 located in a first row and a first column to display (which can be referred as R11 image information);

(2) image information of the first sub-pixel which allows the green first sub-pixel 12 of the first pixel 10 located in the first row and the first column to display (which can be referred as G11 image information);

(3) image information of the first sub-pixel which allows the blue first sub-pixel 13 of the first pixel 10 located in the first row and the first column to display (which can be referred as B11 image information);

(4) image information of the first sub-pixel which allows the red first sub-pixel 11 of the first pixel 10 located in a first row and a second column to display (which can be referred as R12 image information);

(5) image information of the first sub-pixel which allows the green first sub-pixel 12 of the first pixel 10 located in the first row and the second column to display (which can be referred as G12 image information);

(6) image information of the first sub-pixel which allows the blue first sub-pixel 13 of the first pixel 10 located in the first row and the second column to display (which can be referred as B12 image information);

(7) image information of the first sub-pixel which allows the red first sub-pixel 11 of the first pixel 10 located in a second row and a first column to display (which can be referred as R21 image information);

(8) image information of the first sub-pixel which allows the green first sub-pixel 12 of the first pixel 10 located in the second row and the first column to display (which can be referred as G21 image information);

(9) image information of the first sub-pixel which allows the blue first sub-pixel 13 of the first pixel 10 located in the second row and the first column to display (which can be referred as B21 image information);

(10) image information of the first sub-pixel which allows the red first sub-pixel 11 of the first pixel 10 located in a second row and a second column to display (which can be referred as R22 image information);

(11) image information of the first sub-pixel which allows the green first sub-pixel 12 of the first pixel 10 located in the second row and the second column to display (which can be referred as G22 image information); and

(12) image information of the first sub-pixel which allows the blue first sub-pixel 13 of the first pixel 10 located in the second row and the second column to display (which can be referred as B22 image information).

On the basis of the above, the data voltage in the image information of one second sub-pixel (which can be referred as r11 image information) can be obtained through adding the products of multiplying data voltages of the R11 image information and the R12 image information with respective weight coefficients; the data voltage in the image information of one second sub-pixel (which can be referred as g11 image information) can be obtained through adding the products of multiplying data voltages of the G11 image information and the G12 image information with respective weight coefficients; the data voltage in the image information of one second sub-pixel (which can be referred as b11 image information) can be obtained through adding the products of multiplying data voltages of the B11 image information and the B12 image information with respective weight coefficients; the data voltage in the image information of the second sub-pixel (which can be referred as r21 image information) can be obtained through adding the products of multiplying data voltages of the R21 image information and the R22 image information with respective weight coefficients; the data voltage in the image information of the second sub-pixel (which can be referred as g21 image information) can be obtained adding the products of through multiplying data voltages of the G21 image information and the G22 image information with respective weight coefficients; and the data voltage in the image information of the second sub-pixel (which can be referred as b21 image information) can be obtained through adding the products of multiplying data voltages of the B21 image information and the B22 image information with respective weight coefficients.

Later, in order to allow the finally obtained image information to be corresponding to the sub-pixels in the BV3 pixel structure, rearrangement to the position information in the image information of the second sub-pixels is performed so as to obtain the second image information.

It should be understood that, the above-mentioned weight coefficients can be set according to specific implementations on the basis that the above-mentioned weight coefficients satisfy the above-mentioned requirements.

Furthermore, showing the image information of the sub-pixels in FIG. 7 to be the same as corresponding pixel structures is to allow better understanding of the technical solution, but the view in FIG. 7 does not exist in actual image information; both of the image information of the first sub-pixels and the image information of the second sub-pixels include position information by themselves. The above-mentioned regrouping and mergence process can be realized based on the position information included in the image information of the first sub-pixels, and the second sub-pixels are allowed to display based on the position information included in the image information of the second sub-pixels.

Because the above-mentioned algorithm is simple, additional burdens to hardware and buffering in advance can be avoided, and advantages such as fast processing speed, capable of real time processing and good visual effect can be achieved.

Furthermore, compare to the case that the image information for part of the first sub-pixels is deleted, which is illustrated in the specific technical solution of the first method, the specific technical solution of the second method allows the ultimate image information for the second sub-pixels to be more complete and thus better display effect can be realized.

Figure 8:
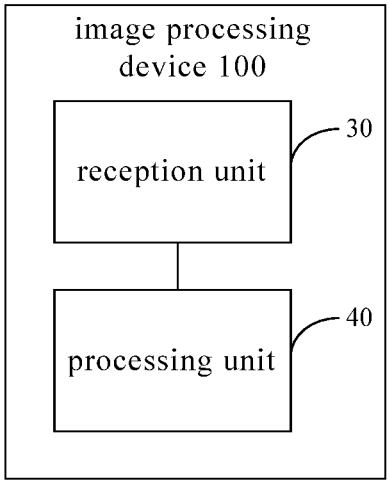
FIG. 8 is a schematic diagram of an image processing device provided by an embodiment of present disclosure.

An embodiment of present disclosure further provides an image processing device for a display device with a BV3 pixel structure, as illustrated in FIG. 8, and the image processing device 100 comprises a reception unit (e.g., receiver) 30 and a processing unit (e.g., processor) 40.

The reception unit 30 is configured for receiving first image information, in which the first image information is image information to be displayed by a first pixel structure; the first pixel structure comprises a plurality of first pixels 10 which are arrayed, each of the first pixels 10 comprises three first sub-pixels sequentially provided along a first direction; all of the first sub-pixels are arranged into a plurality of rows extending along the first direction, and in a second direction different from the first direction, the first sub-pixels in adjacent rows are aligned with each other.

For example, the first image information is received by the display device (such as a TV, a monitor, a cell phone, etc.) through an antenna, a data interface in various types (such as a USB interface or an HDMI interface, etc.) or a network interface, and then obtained through, for example, demodulation by a modem. For example, the image information after decoding can be transformed to gray scale data, and is stored temporarily in an appropriate file format.

The processing unit 40 is coupled to the reception unit 30, and is configured for receiving the first image information inputted from the reception unit 30 and is further configured for transforming the first image information into second image information, in which the second image information is image information to be displayed by a BV3 pixel structure.

In at least one example of the embodiment of the present disclosure, the reception unit 30 and the processing unit 40 can be implemented as a software, a hardware (such as a circuit, an FPGA, etc.), a firmware and/or the like.

In the image processing device provided by at least one embodiment of present disclosure, the second image information is obtained through transforming existing first image information prepared for displaying with the first pixel structure, and can be displayed on the display panel with the BV3 pixel structure. The image processing device can avoid the need to provide the second image information suitable for the display panel with the BV3 pixel structure directly in advance and therefore cost can be reduced and application domains and scenarios of a display device adopting the display panel with the BV3 pixel structure can be increased.

The first image information comprises image information for a plurality of first sub-pixels, in which, image information of each first sub-pixel is used for allowing the each first sub-pixel to display; in this way, the processing unit 40 is configured for transforming the first image information into the second image information. For example, the processing unit 40 is configured for obtaining the second image information through rendering algorithm of rearrangement after deletion or rendering algorithm of rearrangement after mergence with respect to the image information of all the first sub-pixels in the first image information; in which the second image information comprises image information for a plurality of second sub-pixels, and image information for each second sub-pixel in the BV3 pixel structure is used for allowing the each second sub-pixel to display.

For example, obtaining of the second image information through the rendering algorithm of rearrangement after deletion with respect to the image information of all the first sub-pixels in the first image information can be conducted by the processing unit 40 in the following way. The processing unit 40 divides the image information for all the first sub-pixels in the first image information into groups, in which each group comprises image information of twelve first sub-pixels, the image information of the twelve first sub-pixels is used for allowing four first pixels 10 which are arrayed to display, and the four first pixels 10 which are arrayed comprises two rows of first pixels 10, in each of which two first pixels 10 are provided, every two first pixels 10 arranged along the first direction are adjacent to each other, and every two first pixels 10 arranged along the second direction are adjacent to each other; the processing unit further, for the image information of the twelve first sub-pixels comprised by each group, deletes image information of part of the first sub-pixels, and performs position rearrangement with respect to image information of remaining first sub-pixels so as to obtain the second image information.

Alternatively, obtaining of the second image information through the rendering algorithm of rearrangement after mergence with respect to the image information of all the first sub-pixels in the first image information can be conducted by the processing unit 40 in the following way. The processing unit 40 divides the image information for all the first sub-pixels in the first image information into groups, in which each group comprises image information of twelve first sub-pixels, the image information of the twelve first sub-pixels is used for allowing four first pixels 10 which are arrayed to display, and the four first pixels 10 which are arrayed comprises two rows of first pixels 10, in each of which two first pixels 10 are provided, every two first pixels 10 arranged along the first direction are adjacent to each other, and every two first pixels 10 arranged along the second direction are adjacent to each other; the processing unit further, for the image information of the twelve first sub-pixels comprised by each group, adds products, obtained through multiplying data voltages of image information of the first sub-pixels, which are used for allowing the first sub-pixels of same one color and arranged in same one row to display, with respective weight coefficients, to obtain image information of the second sub-pixels, and performs position rearrangement with respect to the image information of the second sub-pixels so as to obtain the second image information.

The specific processes of the processing unit 40 can be referred to descriptions in the above-mentioned display method, and therefore no further descriptions is given here.

An embodiment of present disclosure further provides a display device, which comprises the above-mentioned image processing device.

The processing unit 40 in the image processing device can be connected to a driver IC (integrated circuit), and is configured for providing the second image information to the driver IC, so as to allow the driver IC to drive the display panel with the BV3 pixel structure to display.

Figure 9:
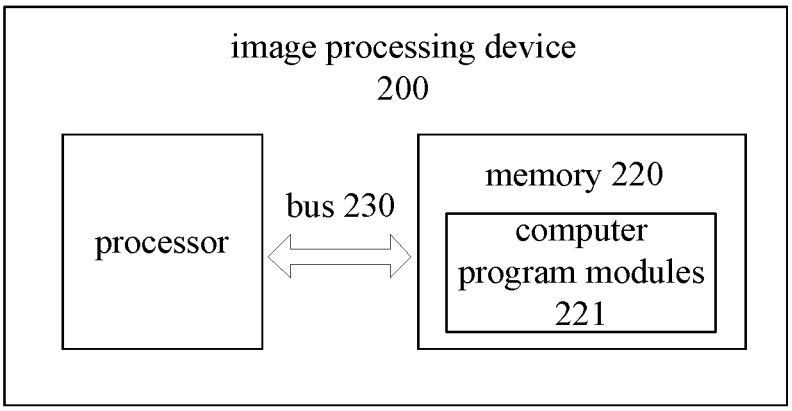
FIG. 9 is a schematic diagram of another image processing device provided by an embodiment of present disclosure.

FIG. 9 is a schematic diagram of another image processing device provided by an embodiment of present disclosure. As illustrated in FIG. 9, the image processing device 200 comprises a processor 210, a memory 220 and one or more computer program modules 221.

For example, the processor 210 and the memory 220 are connected with each other through a bus 230. For example, the one or more computer program modules 221 can be stored in the memory 220. For example, the one or more computer program modules 221 can comprise instructions to execute the display method provided by any one of the embodiments of present disclosure. For example, the instructions in the one or more computer program modules 221 can be executed or run by the processor 210. For example, the bus 230 can be conventional serial communication bus, parallel communication bus or the like, and no specific limitation are given to the embodiment of present disclosure.

For example, the processor 210 can be a central processing unit (CPU) or a processing unit in other forms having data processing capability and/or instruction execution capability; the processor 210 can be implemented as a general-purposed processor or a special-purposed processor, and can control other components in the image processing device 200 so as to realize desired functions. The processor 210 can be a processor in an X86 or ARM architecture, and the like. The memory 220 can be one or more computer program products, and the computer program products can include computer readable storage media in various forms. For example, the computer program products can include a volatile memory and/or a non-volatile memory. The volatile memory, for example, can comprise a random access memory and/or a cache, and the like. The non-volatile memory, for example, can comprise a read-only memory (ROM), a hard disk, a flash memory and the like. The computer readable storage medium can store one or more computer program instructions, and the processor 210 can run the program instructions to realize the functions of an embodiment of the present disclosure (implemented by the processor 210) and/or other desired functions, for example, the image display method and the like. The computer readable storage medium can also store various application programs and various data, for example, the first image information, and various data applied to and/or generated by the application programs.

It should be understood that, not all components of the image processing device 200 of the embodiments of the present disclosure are illustrated for the sake of clarity and conciseness. In order to realize necessary functions of the image processing device 200, those skilled in the art can provide and arrange other components not illustrated and no specific limitation are given to the embodiment of the disclosure.

At least one embodiment of present disclosure further provides a display device, which comprises the image processing device provided by any one of the embodiments of present disclosure. The display device is a liquid crystal display device, an organic light emitting diode display device, or the like.

Figure 10:
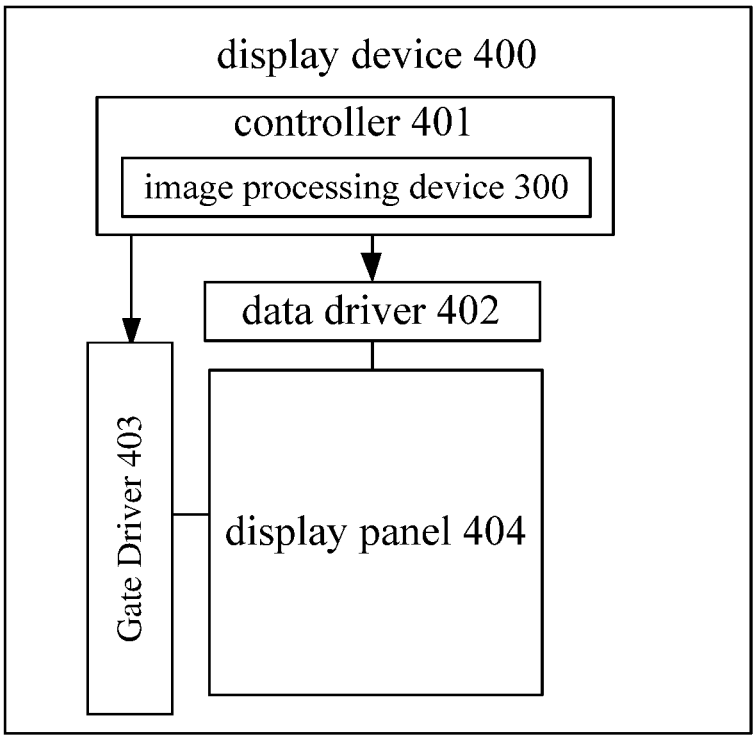
FIG. 10 is a schematic diagram of a display device provided by an embodiment of present disclosure.

FIG. 10 is a schematic block diagram of a display device provided by an embodiment of present disclosure. As illustrated in FIG. 10, the display device 400 comprises the image processing device 300. For example, the image processing device 300 can be the image processing device 200 illustrated in FIG. 8 or FIG. 9.

As illustrated in FIG. 10, the display device can further comprise a controller 401 (for example, a time sequencing controller, T-con), a data driver 402, a gate driver 403, and a display panel 404. For example, the image processing device 300 are provided in the controller 401 and outputs processed display data signals to the data driver 402 under the control of the controller 401.

For example, the display panel 404 is configured to display images. The image data signal to be displayed is inputted into the display device 400 and processed by the image processing device 300, and the display panel 404 performs display based on the processed image data. For example, the display panel 404 can be an organic light-emitting diode display panel.

For example, the gate driver 403 is configured to provide gate scan signals through a plurality of gate lines.

For example, the data driver 402 is configured to receive the output of the image processing device 300 in the controller 401, and then provide the image data signal to the display panel 404. The image data signal is applied to control relative luminous intensity of corresponding sub-pixels during a display operation so as to present specific gray scales.

For example, the data driver 402 and the gate driver 403 can be realized by respective special purposed integrated circuit chips or devices which are directly manufactured on the display panel 404 with semiconductor fabrication processes.

The display device, for example, can also comprise an antenna, a data interface in various types (such as a USB interface or an HDMI interface, etc.) or a network interface (not illustrated in figures), so as to receive inputted data signals, and then to obtain the image information and the like through for example demodulation of the data signals by a modem.

In at least one embodiment, the display device for example can be implemented as any products or device that has display function, such as an LCD panel, an electronic paper, an organic light-emitting diode (OLED) panel, a mobile phone, a tablet PC, a TV, a monitor, a notebook computer, a digital photo frame, and a navigator.

An embodiment of the present disclosure also provides a storage medium. For example, the storage medium stores non-transitory computer readable instructions, and as executed by a computer (which comprises a processor), the non-transitory computer readable instructions performs the display method provided by any one of the embodiments of present disclosure.

For example, the storage medium can be an arbitrary combination of one or more computer readable storage medium; for example, one computer readable storage media comprises computer readable program codes related to the image display method, and other computer readable storage media comprises computer readable program codes for determining current brightness level. For example, the computer can execute the program code stored in the computer readable storage medium and perform an operation method, such as the image display method provided by any one of the embodiments of the present disclosure, in a case that the program code is read by a computer For example, the storage medium can include a disk, a random access memory (RAM), a read-only memory (ROM), an erasable programmable read-only memory (EPROM), a portable compact disc read only memory (CD-ROM), a flash memory, or any combination of the above-mentioned storage mediums; the storage medium also can include other suitable storage medium.

What are described above is related to the illustrative embodiments of the disclosure only and not limitative to the scope of the disclosure; the scopes of the disclosure are defined by the accompanying claims.

What is claimed is:

1. A display method, comprising:

receiving first image information, wherein the first image information is image information to be displayed by a first pixel structure, the first pixel structure comprises a plurality of first pixels which are arrayed, each of the first pixels comprises three first sub-pixels sequentially provided along a first direction, all of the first sub-pixels are arranged into a plurality of rows extending along the first direction, and in a second direction different from the first direction, the first sub-pixels in adjacent rows are aligned with each other; and transforming the first image information into second image information, wherein the second image information is image information to be displayed by a BV3 pixel structure, wherein the first image information comprises image information for the plurality of first sub-pixels, wherein image information of each first sub-pixel is used for allowing the each first sub-pixel to display; and transforming of the first image information into the second image information comprises;

obtaining the second image information through rendering algorithm of rearrangement after deletion with respect to image information of all the first sub-pixels in the first image information, wherein the second image information comprises image information for a plurality of second sub-pixels, and image information of each second sub-pixel in the BV3 pixel structure is used for allowing the each second sub-pixel to display;

wherein obtaining of the second image information through the rendering algorithm of rearrangement after deletion with respect to the image information of all the first sub-pixels in the first image information comprises:

dividing the image information for all the first sub-pixels in the first image information into groups, wherein each group comprises image information of twelve first sub-pixels, the image information of the twelve first sub-pixels is used for allowing four first pixels which are arrayed to display, the four first pixels which are arrayed comprises two rows of first pixels with two first pixels being provided in each row of first pixels, every two first pixels arranged along the first direction are adjacent to each other, and every two first pixels arranged along the second direction are adjacent to each other; and for the image information of the twelve first sub-pixels comprised by each group, deleting image information of part of the first sub-pixels, and performing position rearrangement with respect to image information of remaining first sub-pixels so as to obtain the second image information.

2. An image processing device for a display device with a BV3 pixel structure for performing the method of claim 1, comprising:

a reception unit, which is configured for receiving first image information, wherein the first image information is image information to be displayed by a first pixel structure, the first pixel structure comprises a plurality of first pixels which are arrayed, each of the first pixels comprises three first sub-pixels sequentially provided along a first direction, all of the first sub-pixels are arranged into a plurality of rows extending along the first direction, and in a second direction different from the first direction, the first sub-pixels in adjacent rows are aligned with each other; and a processing unit, which is coupled to the reception unit, and is configured for transforming the first image information into second image information, wherein the second image information is image information to be displayed by a BV3 pixel structure, wherein:

the first image information comprises image information for the plurality of first sub-pixels, wherein image information of each first sub-pixel is used for allowing the each first sub-pixel to display; and the processing unit is configured for obtaining the second image information through rendering algorithm of rearrangement after deletion with respect to image information of all the first sub-pixels in the first image information, wherein the second image information comprises image information for a plurality of second sub-pixels, and image information of each second sub-pixel in the BV3 pixel structure is used for allowing the each second sub-pixel to display;

wherein:

the processing unit is configured for dividing the image information of all the first sub-pixels in the first image information into groups, wherein each group comprises image information of twelve first sub-pixels, the image information of the twelve first sub-pixels is used for allowing four first pixels which are arrayed to display, the four first pixels which are arrayed comprises two rows of first pixels with two first pixels being provided in each row of first pixels, every two first pixels arranged along the first direction are adjacent to each other, and every two first pixels arranged along the second direction are adjacent to each other; and the processing unit is further configured for, for the image information of the twelve first sub-pixels comprised by each group, deleting image information of part of the first sub-pixels, and performing position rearrangement with respect to image information of remaining first sub-pixels so as to obtain the second image information.

3. A display device, comprising the image processing device according to claim 2.

4. An image processing device, comprising:

a processor;

a memory; and one or more computer program modules, wherein the one or more computer program modules are stored in the memory and are capable of being executed by the processor, the one or more computer program modules comprise instructions to execute the display method according to claim 1.

5. A display device, comprising the image processing device according to claim 4.

6. A non-transitory storage medium for storing computer readable instructions, wherein as executed by a computer, the non-transitory computer readable instructions performs the display method according to claim 1.

7. A display method, comprising:

receiving first image information, wherein the first image information is image information to be displayed by a first pixel structure, the first pixel structure comprises a plurality of first pixels which are arrayed, each of the first pixels can three first sub-pixels sequentially provided along a first direction, all of the first sub-pixels are arranged into a plurality of rows extending along the first direction, and in a second direction different from the first direction, the first sub-pixels in adjacent rows are aligned with each other; and transforming the first image information into second imago information, wherein the second image information is image information to be displayed by a BV3 pixel structure, wherein the first image information comprises image information for the plurality of first sub-pixels, wherein image information of each first sub-pixel is used for allowing the each first sub-pixel to display; and transforming of the first image information into the second image information comprises:

obtaining the second image information through rendering algorithm of rearrangement after mergence respect to image information of all the first sub-pixels in the first image information, wherein the second image information comprises image information for a plurality of second sub-pixels, and image information of each second sub-pixel in the BV3 pixel structure is used for allowing the each second sub-pixel to display, wherein obtaining of the second image information through the rendering algorithm of rearrangement after mergence with the image information of all the first sub-pixels in the first image information comprises:

dividing the image information of all the first sub-pixels in the first image information into groups, wherein each group comprises image information of twelve first sub-pixels, the image information of the twelve first sub-pixels is used for allowing four first pixels which are arrayed to display, the four first pixels which are arrayed comprises two rows of first pixels with two first pixels being provided in each row of first pixels, every two first pixels arranged along the first direction are adjacent to each other, and every two first pixels arranged along the second direction are adjacent to each other; and for the image information of the twelve first sub-pixels comprised by each group, adding products, obtained through multiplying data voltages of image information of the first sub-pixels, which are used for allowing the first sub-pixels of same one color and arranged in same one row to display, with respective weight coefficients, to obtain image information of the second sub-pixels, and performing position rearrangement to the image information of the second sub-pixels so as to obtain the second image information.

8. The display method according to claim 7, wherein, for the image information of the twelve first sub-pixels comprised by each group, a sum of the respective weight coefficients of the data voltages of the image information of the first sub-pixels, which are used for allowing the first sub-pixels of same one color and arranged in same one row to display, is one.

9. An image processing device for a display device with a BV3 pixel structure for performing the method of claim 7, comprising:

a reception unit, which is configured for receiving first image information, wherein the first image information is image information to be displayed by a first pixel structure, the first pixel structure comprises a plurality of first pixy which are arrayed, each of the first pixels comprises three first sub-pixels sequentially provided along a first direction, all of the first sub-pixels are arranged into a plurality of rows extending along the first direction, and in a second direction different from the first direction, the first sub-pixels in adjacent rows are aligned with each other; and a processing unit, which is coupled to the reception unit, and is configured for transforming the first image information into second image information, wherein the second image information is image information to be displayed by BV3 pixel structure, wherein:

the first image information comprises image information for the plurality of first sub-pixels, wherein image information of each first sub-pixel is used for allowing the each first sub-pixel to display; and the processing unit is configured for obtaining the second image information through rendering algorithm of rearrangement after mergence with respect to image information of all the first sub-pixels in the first image information, wherein the second image information comprises image information for a plurality second sub-pixels, and image information of each second sub-pixel in the BV3 pixel structure is used allowing the each second sub-pixel to display;

wherein:

the processing unit is configured for dividing the image information of all the first sub-pixels in the first image information into groups, wherein each group comprises image information of twelve first sub-pixels, the image information of the twelve first sub-pixels is used for allowing four first pixels which are arrayed to display, the four first pixels which are arrayed comprises two rows of first pixels with two first pixels being provided in each row of first pixels, every two first pixels arranged along the first direction are adjacent to each other, and every two first pixels arranged along the second direction are adjacent to each other; and the processing unit is further configured for, for the image information of the twelve first sub-pixels comprised by each group, adding products, obtained through multiplying data voltages of image information of the first sub-pixels, which are used for allowing the first sub-pixels of same one color and arranged in same one row to display, with respective weight coefficients, to obtain image information of the second sub-pixels, and performing position rearrangement to the image information of the second sub-pixels so as to obtain the second image information.

10. A display device, comprising the image processing device according to claim 9.

11. An image processing device, comprising:

a processor;

a memory; and one or more computer program modules, wherein the one or more computer program modules are stored in the memory and are capable of being executed by the processor, the one or more computer program modules comprise instructions to execute the display method according to claim 7.

12. A display device, comprising the image processing device according to claim 11.

13. A non-transitory storage medium for storing computer readable instructions, wherein as executed by a computer, the non-transitory computer readable instructions performs the display method according to claim 7.

* * * * *